United States Patent [19]

Steinike

[11] Patent Number: 5,008,972

[45] Date of Patent: Apr. 23, 1991

[54] CLEANING DEVICE FOR TEXTILE MACHINES DISPOSED IN A ROW

[75] Inventor: Ulrich Steinike, Augsburg, Fed. Rep. of Germany

[73] Assignee: Ernst Jacobi & Co. KG, Augsburg, Fed. Rep. of Germany

[21] Appl. No.: 539,556

[22] Filed: Jun. 18, 1990

Related U.S. Application Data

[63] Continuation-in-part of Ser. No. 215,382, Jul. 5, 1988, abandoned.

[30] Foreign Application Priority Data

Sep. 18, 1987 [DE] Fed. Rep. of Germany ..... 3731449

[51] Int. Cl.[5] ..... D01G 15/76

[52] U.S. Cl. ..... 15/312.2; 15/319; 15/345

[58] Field of Search ..... 15/312.1, 312.2, 319, 15/316.1, 345

[56] References Cited

U.S. PATENT DOCUMENTS

| | | | |
|---|---|---|---|
| 1,463,583 | 7/1923 | Holleran | 15/345 X |
| 2,758,041 | 8/1956 | Denning | 15/345 X |
| 3,001,222 | 9/1961 | Preston | 15/312.1 |
| 3,080,598 | 3/1963 | McEachern | 15/312.1 |
| 3,305,184 | 2/1967 | Seress et al. | 15/312.1 X |
| 3,997,936 | 12/1976 | Smith, Jr. et al. | 15/301 |

*Primary Examiner*—Chris K. Moore

*Attorney, Agent, or Firm*—Pascal & Associates

[57] ABSTRACT

Cleaning apparatus for textile machines disposed in a row, which cleaning apparatus can be moved back and forth among the textile machines. The cleaning apparatus has blow hoses provided with nozzles to blow off loose fuzz from the textile machines, and at least one suction hose for sucking up the blown off fuzz. For each textile machine at least one stationary blower is disposed at the machine side opposite from the suction hose and has at least one blast nozzle for blowing air covering the floor below the textile machines. The cleaning apparatus has a vertically extending, relatively rigid air blast duct which docks at the blower when the cleaning apparatus is aligned with the blower.

22 Claims, 5 Drawing Sheets

CLEANING DEVICE FOR TEXTILE MACHINES DISPOSED IN A ROW

This is a continuation-in-part application of Ser. No. 215,382 filed July 5, 1988, and now abandoned.

The invention relates to a cleaning device for textile machines disposed in a row in which a cleaning apparatus can be moved back and forth amongst those machines and which has blow hoses provided with nozzles to blow off loose fuzz and at least one suction hose for sucking up the blown off fuzz.

To clean textile machines, movable cleaning devices move along a row of textile machines and are guided on rails above the textile machines. Such a cleaning device has several blow hoses on which nozzles are disposed which direct air streams at the textile machines. The loose fuzz which is blown off thereby collects on the floor from where it is sucked up by at least one suction hose. The loose fuzz which is sucked up is collected in the cleaning device.

The critical cleaning area is in the area of the floor below the textile machines. It is known to arrange a blow hose on the cleaning device, which is led to the floor and which has a blast nozzle which produces a horizontal air stream which is directed to the opposite side of the textile machine. On the opposite side of the textile machine, a suction hose extends to the floor which catches the loose fuzz carried along by the air blast stream. However, in this known cleaning device, the cleaning capability in the floor area below the textile machines is not satisfactory. The reason for this is in that the amount of the pressure of the air blast issuing from the above-noted blast nozzle is not adequate. It should be noted that the distance of the blow hose to the textile machines is determined by the maximum width of the textile machines. Due to this distance, the blowing effect is relatively slight in the critical areas below the textile machines.

It is an object of the invention to improve this cleaning device in such a way that the floor areas below the textile machines are effectively freed of loose fuzz and that this loose fuzz is taken up by at least one suction hose.

A preferred embodiment of the invention is a cleaning device for textile machines disposed in a row, in which a cleaning apparatus can be moved back and forth above these machines and which has blow hoses provided with nozzles to blow off loose fuzz and at least one suction hose for sucking up the blown off fuzz. For each textile machine at least one stationary blow part is disposed at the machine side turned away from the suction hose, and has at least one blast nozzle for blowing air covering the flow below the textile machine. The cleaning apparatus has a vertically extending, relatively rigid air blast duct which docks at the blow part when the cleaning apparatus is at the level of the blow part.

Embodiments of the invention are described in greater detail below, with reference to the following drawings, in which.

Figure 1:
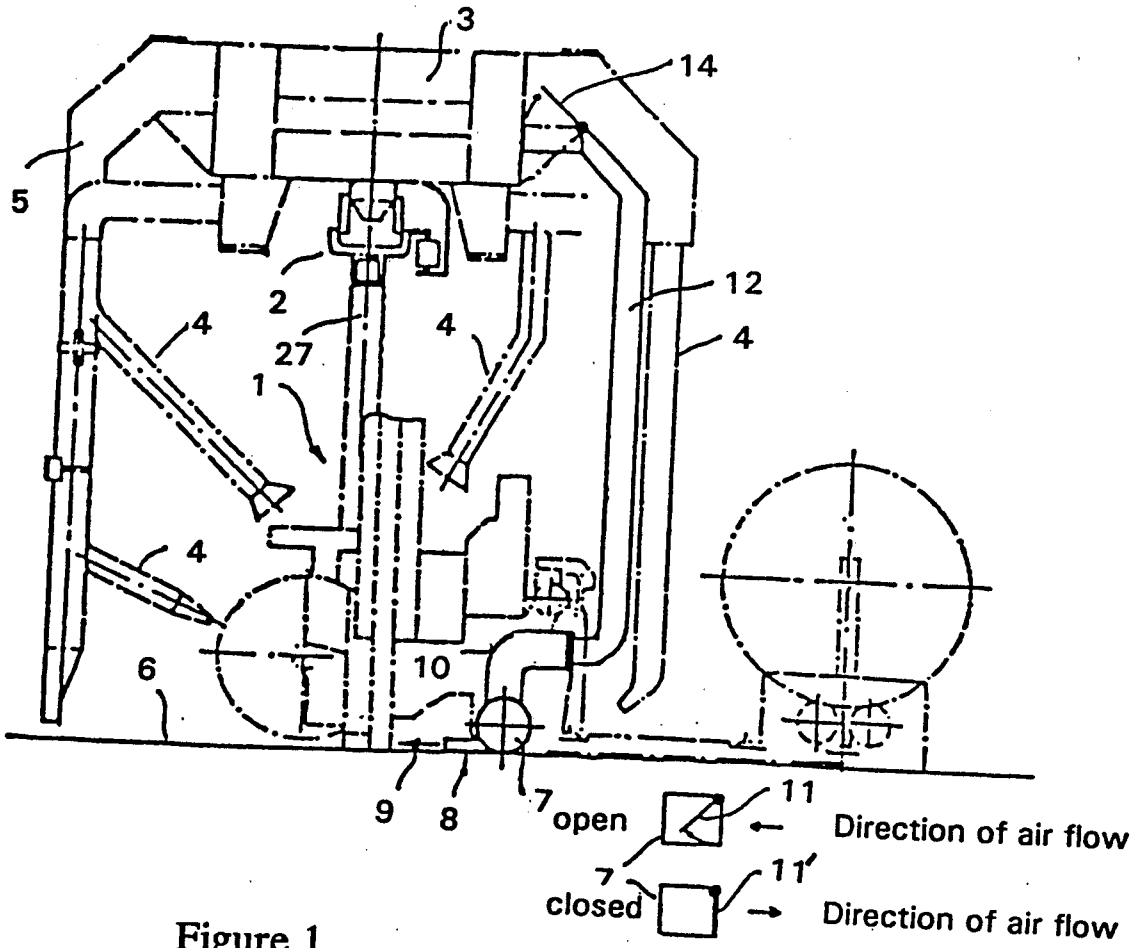
FIG. 1 is a front view of a row of textile machines and the cleaning device.

This cleaning apparatus is suitable, in particular, for cleaning ring spinning and weaving machines which are disposed in a row. The cleaning apparatus 3 can be moved back and forth on rails 2 above these textile machines 1. Several blow hoses 4, whose mouthpieces or nozzles are directed against the textile machines 1, extend from this cleaning apparatus 3. Furthermore, at least one suction hose 5 is provided whose mouthpiece is in the region of floor 6. The cleaning apparatus travels in well-known manner to one end of the row of textile machines, then back to the other end, again to the one end and so on.

A stationary duct 7 extends along the floor 6 of each textile machine 1. This duct 7 is disposed at the side of machine 1 opposite the travel path of the suction hose 5. It has several blast nozzles 8 which extend horizontally and are directed toward that machine side along which the suction hose 5 travels.

Duct 7 has a first connecting tube 10 at its one end and a second connecting tube 10' at its other end. Two valves 11, 11' are disposed between each corresponding connecting tube 10, 10' and duct 7. The valves 11, 11' open toward the inside of duct 7, as is indicated by the arrows shown there. The connecting tubes 10, 10' extend horizontally in their upper area and vertically in their lower area, connected with duct 7 via valves 11, 11'.

The cleaning apparatus 3 is provided with a relatively rigid air blast duct 12 which extends vertically. This air blast duct 12 extends horizontally in its lower region, whereby its lower opening aligns with the openings of the connecting tubes 10 when the cleaning apparatus 3 moves along the textile machine 1. Between the fan of the cleaning apparatus 3 and the blast duct 12 and blow hoses 4 a valve 14 is provided which can be actuated electromechanically to close the blast duct 12 or the blow hoses 4.

Figure 2:
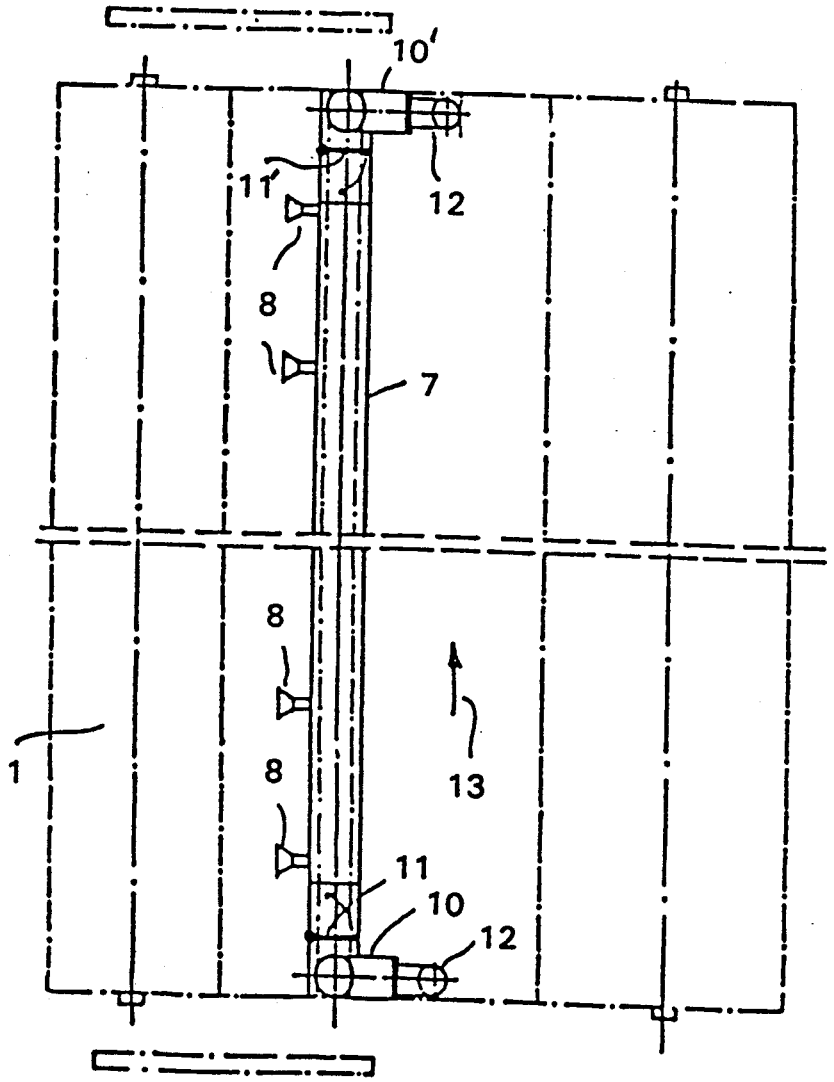
FIG. 2 is a top view onto a part of a textile machine of the row.

When the cleaning apparatus 3 travels, as shown in FIG. 2, in the direction of arrow 13 and when the cleaning apparatus 3 arrives at a position in which the air blast duct 12 aligns at its lower end with the upper end of the connecting tube 10, then the cleaning apparatus 3 is temporarily stopped and the valve 14 is actuated to close blow hoses 4 and to connect the blast duct 12 with the fan. While stopped, therefore, this air blast duct 12 docks at the connecting tube 10. The air conveyed through the air blast duct 12 penetrates into duct 7, whereby the valve 11 in FIG. 2 is opened by the air stream which enters in tube 10, while the other valve 11' is kept closed by the pressure built up in duct 7. As a result, the air blast entering into duct 7 flows out via the nozzles 8 as designated with arrow 9 and causes the loose fuzz found below the textile machine 1 to be blown along the floor 6 underneath machine 1 to that side of the textile machine on which the suction hose 5 travels.

After the docking is ended the valve 14 is actuated again to close the blast duct 12 and to connect the blow hoses 4 with the fan and the apparatus 3 travels further in direction of arrow 13, whereby the suction hose 5 sweeps that area of floor 6 in which the loose fuzz had previously been blown by the air blast 9. The air streams from the blow hoses 4 clean the textile machine 3.

When the cleaning apparatus 3 reaches the second connecting tube 10' shown in FIG. 2, then no stopping of the cleaning device 3 takes place. Loose fuzz is thus prevented from being blown to the left side of the previously cleaned machine 1 when the cleaning device 3 moves away from this machine to the next machine in the row at which the above sequence is repeated.

When cleaning apparatus 3 returns in direction against arrow 13, the cleaning apparatus 3 stops at the level of the second connecting tube 10' as in FIG. 2, whereby the blast duct 12 docks at the connecting tube 10. The valve 14 is actuated again as described in connection with the docking at the tube 10 so that the air enters in the blast duct 12. Air blast is then supplied to duct 7, as was previously described with reference to docking at the first connecting tube 10. At the end of the docking at tube 10' the valve 14 is actuated to close the blast duct 12 so that air blast is supplied to the blow hoses 4. When cleaning apparatus 3 moves further against the direction of arrow 13, then the first connecting tube 10 is then passed over without stopping.

The described control is designed in such a way that valve 14 only opens to blast duct 12 while docking at connecting tubes 10, 10'. Further the air supply to the blow hoses 4 can be throttled during docking by means of suitable valve controls and not interrupted as described above.

Figure 6:
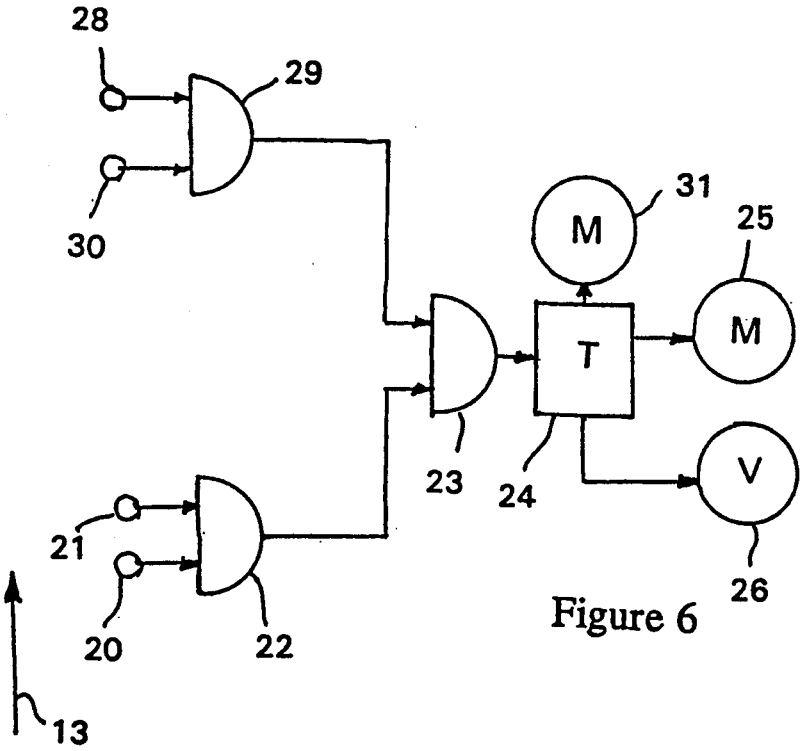
FIG. 6 is a schematic diagram of a circuit to control docking and actuation of a valve.

The control of the docking and of the actuation of valve 14 is described with reference to FIG. 6. At the duct 10 two sensors 20, 21 are provided along the travel path of the blow duct 12 on which means are provided to influence the sensors, for example a permanent magnet piece. These sensors are connected to the inputs of a first gate 22 with an output connected to a further gate 23. The output of gate 23 is connected to a timer 24 which is connected to the travelling motor 25 and to the actuator 26 of valve 14 via conduits along the rails 2. At the duct 10' two further sensors 30 and 28 are provided, connected to the inputs of a second gate 29 which is connected with its output to the gate 23.

When the cleaning device 3 approaches duct 10 in the direction of arrow 13 first the sensor 20 and then the sensor 21 generate a signal and with this sequence of signals the gate 22 generates an output signal to actuacte the timer 24 via gate 23. The timer 24 generates an output signal to stop the motor 25 and to actuacte valve 14. Therefore the device 3 is temporarily stopped, the air blast duct 12 docks at tube 10 and air is supplied to duct 12. After a preset period the output signals of timer 24 are ceased so that the motor 25 drives the device 3 again in the direction of arrow 13 and the valve 14 returns in its original position to close duct 12.

When the device 3 approaches duct 10' in the direction of arrow 13 first the sensor 30 and then the sensor 28 generate output signals. With this sequence of signals the gate 29 does not open so that the device 3 travels without docking on duct 10'.

When the device 3 travels against the direction of arrow 13 and approaches duct 10' first the sensor 28 and then the sensor 30 generate output signals and with this sequence the second gate 29 generates an output signal to activate the timer 24 via gate 23. Therefore the motor 25 is stopped and the actuator 26 is actuated so that air is supplied to duct 12.

After a preset period the output signals of timer are ceased so that the motor 25 drives the device 3 again against the direction of arrow 13 and the valve 14 returns in its original position to close duct 12.

When the device 3 approaches duct 10 against the direction of arrow 13 first the sensor 21 and then the sensor 20 generate output signals. With this sequence of signals the gate 22 does not open so that the device 3 travels without docking at duct 10.

Figure 3:
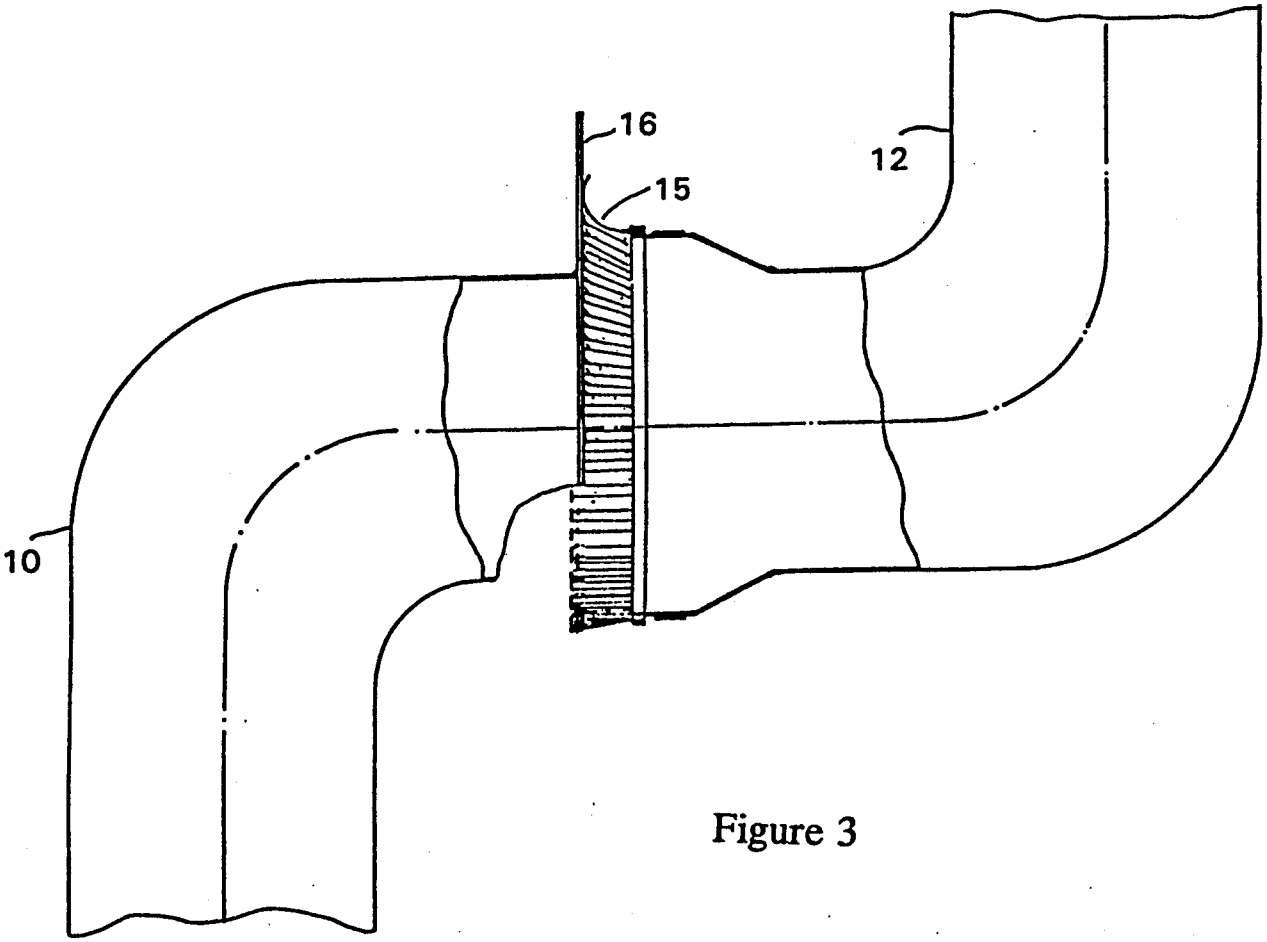
FIG. 3 is a side view of an embodiment of the lower end of the block duct and the upper end of the blow part while docking.

The lower opening of blow duct 12 is surrounded by a number of elastic sealing lamellae 15 like a circular brush. The upper opening of each connecting tube 10, 10' is surrounded by a circular shield 16. When the cleaning apparatus is temporarily stopped at the connecting tube 10 or 10' then the lower opening of blow duct 12 aligns with the upper opening of connecting tube 10 or 10' and the lamellae 15 abut against shield 16, which produces an effective sealing between the openings of blow duct 12 and connecting tube 10, 10'. That means that during the stop of the cleaning apparatus 3 at the connecting tube 10 or 10' the opening of blow duct 12 and the opening of connecting tube 10 or 10' are connected to one another by the circular brush of lamellae 15 which lie with their ends close to the shield 16. This is illustrated at the top of FIG. 3. In the bottom of this figure the lamellae 15 are shown when the cleaning apparatus travels and the lamellae 15 are not in contact with a shield 16.

Blow duct 12 extends at a distance from the longitudinal axis of machine 1 which is determined by the maximum width of machine 1 on the right of longitudinal axis 27. This corresponds to the distance of the above-noted blow hose as in the prior art apparatus, whose nozzle is directed into the floor area below the textile machine 1. Because duct 7 is disposed substantially closer to the longitudinal axis 27, as a result the blowing effect is stronger in the floor area below this machine compared to the prior art apparatus.

Figure 4:
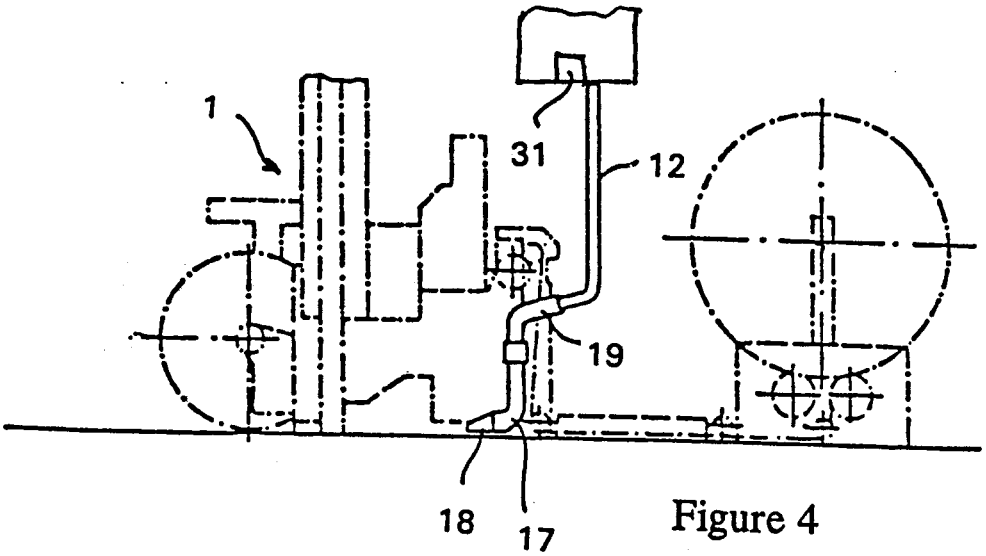
FIG. 4 is a view corresponding to FIG. 1 showing a second embodiment of the invention.
Figure 5:
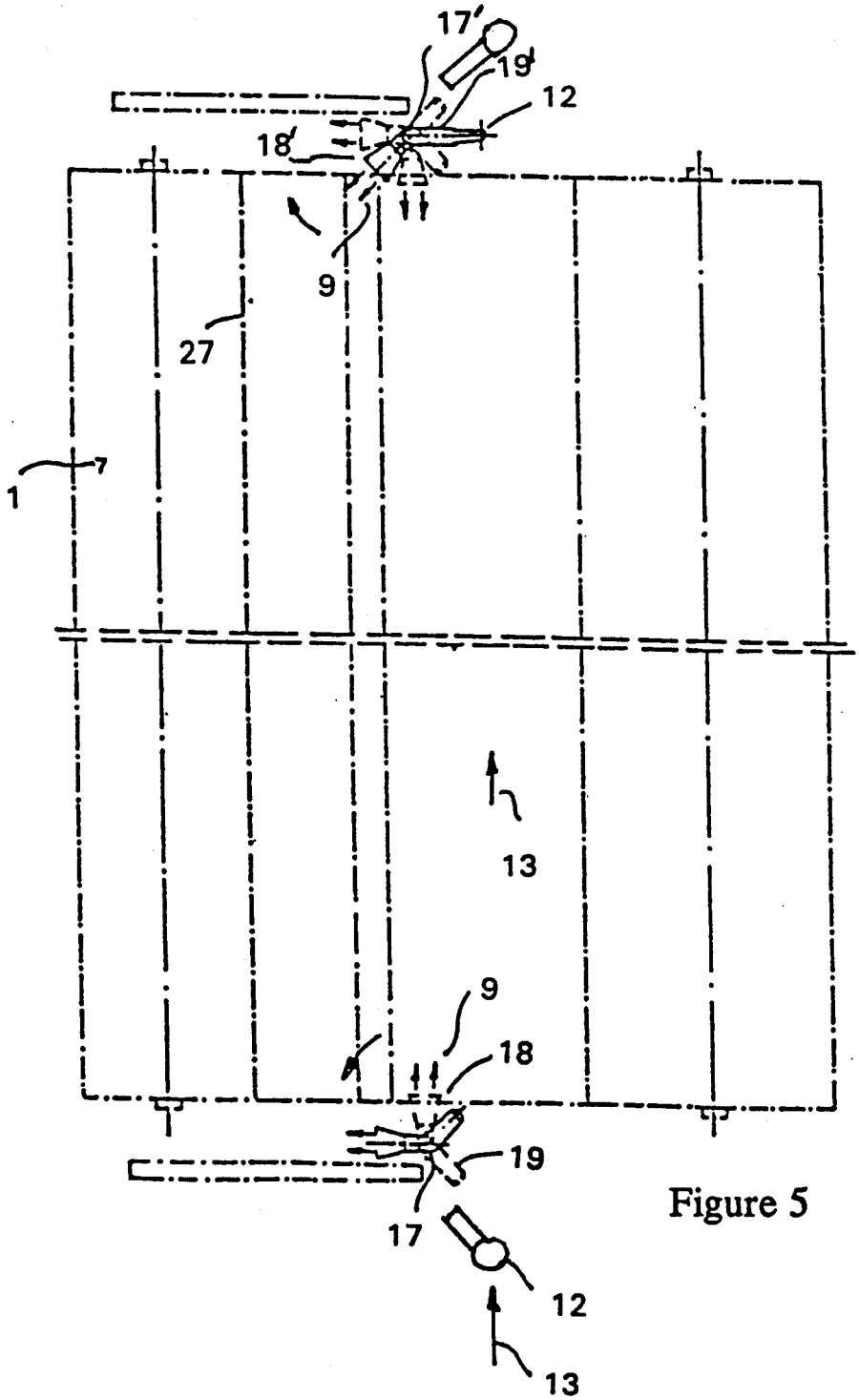
FIG. 5 is a top view corresponding to FIG. 2 in this second embodiment.

A second embodiment is shown in FIGS. 4 and 5. Nozzle means are disposed at each end of textile machine 1, each nozzle means comprising an S-shaped, curved connecting tube 17, 17', whose mid-section extends vertically and whose lower end terminates in blast nozzles 18, 18'. Each connecting tube 17 can be rotated by 90 degrees about a vertical axis. In one end position, the blast nozzles 18, 18' are aligned transversely to the longitudinal axis 27 of machine 1, whereas, in the other end position, the nozzles 18, 18' extend parallel to this longitudinal axis.

The horizontal axis of the blast nozzles 18, 18' and the upper ends 19, 19' of the connecting tubes 17, 17' are displaced to one another by an angle of about 135°. Therefore, as illustrated at the bottom of FIG. 5 by dash-dotted lines, in the one end position when the nozzle 18 extends parallel to axis 27 the upper end 19 is directed about 45° against the direction of arrow 13 and in the other end position when the nozzle 18 is disposed perpendicular to axis 27 the upper end 19 is directed about 45° in the direction of arrow 13 as shown in solid lines.

As shown at the top of FIG. 5 when the nozzle 18' extends parallel to axis 27 the upper end 19' is directed about 45° in the direction of arrow 13 and when the nozzle 18' extends perpendicular to axis 27 the upper end 19' extends about 45° against the direction of arrow 13. Further in this embodiment the blast duct 12 is rotatable about its vertical axis by 90° by motor means 31.

When cleaning apparatus 3 travels in direction of arrow 13, the lower bent of the blast duct 12 extends about 45° to the direction of arrow 13 as shown at the bottom of FIG. 5. When the cleaning apparatus 3 comes to tube 17 then the lower bent end of the blast duct 12 engages with the upper end 19 of the connecting tube 17, which is illustrated at the bottom of FIG. 5 by dash-dotted lines. The nozzle 18 initially assumes the position parallel to axis 27 as illustrated by dash-dotted lines at the bottom of FIG. 5. The lower bent end of blast duct 12 grips like a finger in the upper opening of the tube 17 as shown in FIG. 4. In this moment the valve 14 is actuated as described in connection with the first embodiment but in contrast to the first embodiment the cleaning apparatus is not stopped but travels further in the direction of arrow 13. The air blast stream then flows out from nozzle 18 approximately parallel to the longitudinal axis 27 of machine 1. When the cleaning device 3 continues to travel in direction of arrow 13, connecting tube 17 is rotated by 90 degrees counterclockwise about its vertical axis of rotation, because duct 12 still engages in the upper end 19 of connecting tube 17. The nozzle 18 and, therewith, the air blast stream issuing from it carry out a rotation of 90 degrees counterclockwise, whereby the entire floor area below the machine 1 is swept by the air blast stream. By the engagement of blast duct 12 and tube 17 also the tube 17 is rotated by 90 degrees counterclockwise. In the position shown by a solid line at the bottom of FIG. 5, blast duct 12 and connecting tube 17 disengage. In this moment the valve 14 returns in its normal position as described in connection to the first embodiment. At the end of the docking the lower bent end of blast duct 12 extends 45 degrees against the direction of arrow 13. The blast duct 12 is rotated back by its motor means 31 so that its lower bent end extends 45 degrees in the direction of arrow 13. To control this motor means 31 the timer 24 energizes the motor means 31 when the valve 14 is deenergized. When the cleaning apparatus 3 travels further over the textile machine 1 in direction of arrow 13, the loose fuzz, blown off by the air blast stream below the machine 1, is sucked up by suction hose 5.

When the cleaning apparatus 3 reaches connecting tube 17', shown at the top in FIG. 5, then a docking takes place as described in connection with the docking at tube 17 but the valve 14 is not actuated as described in the first embodiment. The cleaning apparatus 3 travels further in the direction of arrow 13 and at the end of this docking the upper end 19' of the connecting tube 17' extends about 45 degrees in the direction of arrow 13 and the lower bent end extends about 45 degrees against this direction. After the end of the docking the blast duct 12 is rotated again by the motor means 31 so that its lower bent end extends again 45 degrees in the direction of arrow 13 for docking with tube 17 of the next textile machine.

When the cleaning apparatus 3 reaches the end of the row of textile machines the apparatus 3 stops and returns against the direction of arrow 13. Further the blast duct 12 is rotated by 90 degrees so that its lower bent end extends 45 degrees against the direction of arrow 13 as shown at the top of FIG. 5. When the cleaning apparatus reaches connecting tube 17', shown at the top in FIG. 5, while returning against the direction of arrow 13, then a docking and rotation takes place there, as was previously described with reference to the connecting tube 17 when the cleaning apparatus 3 travels in the direction of arrow 13. At the beginning of this docking at tube 17' the valve 14 is actuated as described in connection with the first embodiment. During docking and rotation at tube 17' the nozzle 18' and the air blast stream issuing from it carry out a rotation of 90 degrees clockwise whereby the entire floor area is swept by the air blast stream, see arrow at the top of FIG. 5. At the end of this docking at tube 17' the valve 14 is deenergized so that the duct 12 is closed. At the same time the duct 12 is rotated by the motor means 31 so that the lower bent end returns in a position as shown at the top of FIG. 5 that means it extends 45 degrees against the direction of arrow 13. When the cleaning apparatus 3 travels further against the direction of arrow 13 the loose fuzz is sucked up by suction hose 5. When the cleaning device 3 moves further against the direction of arrow 13 a docking takes place at connecting tube 17 but the valve 14 is not actuated as described in connection with the docking at connecting tube 17' when the cleaning apparatus travels in direction of arrow 13.

The rotation of the connecting tubes 17, 17', or nozzles 18, 18', can also be brought about by an automatic drive during docking. In the illustrated embodiment, blast duct 12 is rotatable, in order to produce the rotation of the connecting tube 17. While the cleaning apparatus 3 is moving on after docking the lower bent end of blow duct 12 is always aligned diagonally toward the front in the direction of movement, so that a docking at the upper end 19, 19' of connecting tube 17, 17', similarly aligned in a diagonal manner, is possible. In the illustrated embodiment, the rotation of the connecting tube 17, 17' is produced merely by the movement of the cleaning device 3 along the longitudinal axis of the textile machines 1.

I claim:

1. A cleaning device for textile machines disposed in a row, comprising a cleaning apparatus for movement back and forth above said machines including blow hoses provided with nozzles for blowing off loose fuzz and at least one suction hose for sucking up the blown off fuzz, at least one stationary blowing means disposed at a side of each machine opposite the suction hose, the blowing means having at least one blast nozzle for blowing air so as to cover the floor below the textile machine, the cleaning apparatus having a vertically extending, substantially rigid air blast duct for docking at the blowing means when the cleaning apparatus is aligned with the blowing means.

2. A cleaning device according to claim 1, including means for stopping the cleaning apparatus while the cleaning apparatus is docked at the blowing means.

3. A cleaning device according to claim 1 including means for docking the air blast duct at the blowing means before the cleaning apparatus travels over the textile machine.

4. A cleaning device according to one of claims 1, 2 or 3, including means for throttling the air supply to the blow hoses during said docking.

5. A cleaning device according to claim 4, further including elastic sealing lamellae surrounding the end of the duct disposed at the docking end of the air blast duct, a shield surrounding the opening of the blowing means, said sealing lamellae disposed so as to abut said shield surrounding the opening of the blowing means during docking.

6. A cleaning device according to claim 4, in which the blowing means has a blast nozzle which can be turned about a vertical axis of rotation; means for causing said blast nozzle to rotate while docking about 90 degrees between positions which are transverse and parallel to the longitudinal axis of the textile machine.

7. A cleaning device according to claim 6, in which the means for causing the blast nozzle to rotate is a docked and rotating air blast duct.

8. A cleaning device according to claim 6, in which the means for causing the blast nozzle to rotate is the cleaning apparatus while passing the blast nozzle and air blast duct.

9. A cleaning device according to claim 6, in which the lower end of the air blast duct is angled so as to engage with an angled portion of the blowing means extending parallel to the air blast duct.

10. A cleaning device according to one of claims 1, 2 or 3, in which the blowing means has a duct which extends horizontally along the textile machines and has several blast nozzles, said duct being connected to at least one connecting tube at which the air blast duct docks.

11. A cleaning device according to claim 10, in which the duct has a connecting tube at each of its ends.

12. A cleaning device according to claim 11, in which a valve, opening in the direction of the duct, is disposed between the duct and each of the connecting tubes.

13. A cleaning device according to claim 11, including means for stopping the air supply to the air blast duct when the second connecting tube, seen in direction of travel, is passed.

14. A cleaning device according to claim 10, further including elastic sealing lamellae surrounding the end of the duct disposed at the docking end of the air blast duct, a shield surrounding the opening of the blowing means, said sealing lamellae disposed so as to abut said shield surrounding the opening of the blowing means during docking.

15. A cleaning device according to one of claims 1, 2 or 3, further including elastic sealing lamellae surrounding the end of the duct disposed at the docking end of the air blast duct, a shield surrounding the opening of the blowing means, said sealing lamellae disposed so as to abut said shield surrounding the opening of the blowing means during docking.

16. A cleaning device according to one of claims 1, 2 or 3, in which the blowing means has a blast nozzle which can be turned about a vertical axis of rotation; means for causing said blast nozzle to rotate while docking about 90 degrees between positions which are transverse and parallel to the longitudinal axis of the textile machine.

17. A cleaning device according to claim 16, in which the means for causing the blast nozzle to rotate is a docked and rotating air blast duct.

18. A cleaning device according to claim 17, in which the lower end of the air blast duct is angled so as to engage with an angled portion of the blowing means extending parallel to the air blast duct.

19. A cleaning device according to claim 16, in which the means for causing the blast nozzle to rotate is the cleaning apparatus while passing the blast nozzle and air blast duct.

20. A cleaning device according to claim 19, in which the lower end of the air blast duct is angled so as to engage with an angled portion of the blowing means extending parallel to the air blast duct.

21. A cleaning device according to claim 16, in which the lower end of the air blast duct is angled so as to engage with an angled portion of the blower extending parallel to the air blast duct.

22. A cleaning device according to claim 21, including means in the cleaning apparatus for stopping the air supply to the air blast duct while a second blowing means, seen in direction of travel, docks.

* * * * *